US009874027B2

(12) United States Patent
Pervan et al.

(10) Patent No.: US 9,874,027 B2
(45) **Date of Patent: *Jan. 23, 2018**

(54) MECHANICAL LOCKING SYSTEM FOR FLOOR PANELS

(71) Applicant: CERALOC INNOVATION AB, Viken (SE)

(72) Inventors: Darko Pervan, Viken (SE); Tony Pervan, Stockholm (SE)

(73) Assignee: CERALOC INNOVATION AB, Viken (SE)

( * ) Notice: Subject to any disclaimer, the term of this patent is extended or adjusted under 35 U.S.C. 154(b) by 0 days.

This patent is subject to a terminal disclaimer.

(21) Appl. No.: 15/048,252

(22) Filed: Feb. 19, 2016

(65) Prior Publication Data

US 2016/0168866 A1 Jun. 16, 2016

Related U.S. Application Data

(63) Continuation of application No. 14/152,402, filed on Jan. 10, 2014, now Pat. No. 9,284,737, which is a (Continued)

(51) Int. Cl.
*E04F 15/02* (2006.01)
*E04C 2/00* (2006.01)

(52) U.S. Cl.
CPC ..... *E04F 15/02038* (2013.01); *E04F 15/02* (2013.01); *E04F 2201/0138* (2013.01); (Continued)

(58) Field of Classification Search
CPC ..... E04F 15/02; E04F 15/02038; E04F 2201/0138; E04F 2201/0523; (Continued)

(56) References Cited

U.S. PATENT DOCUMENTS 87,853 A 3/1869 Kappes
108,068 A 10/1870 Utley
(Continued)

FOREIGN PATENT DOCUMENTS

CA 2456513 A1 2/2003
CN 201588375 U 9/2010
(Continued)

OTHER PUBLICATIONS

U.S. Appl. No. 13/670,039, Darko Pervan, Niclas Håkansson and Per Nygren, filed Nov. 6, 2012.
(Continued)

*Primary Examiner* — Charles A Fox
*Assistant Examiner* — Joseph J. Sadlon
(74) *Attorney, Agent, or Firm* — Buchanan Ingersoll & Rooney PC

(57) ABSTRACT

Floor panels are shown, which are provided with a vertical locking system on short edges comprising a displaceable tongue that is displaced in one direction into a tongue groove during vertical displacement of two panels. The displaceable tongue may be provided in a sidewardly open displacement groove at an edge of a building panel, the displaceable tongue including a main body extending along the edge of the panel and a tongue locking surface located at an upper and outer part of the tongue.

23 Claims, 7 Drawing Sheets

Related U.S. Application Data continuation of application No. 13/546,569, filed on Jul. 11, 2012, now Pat. No. 8,650,826.

(60) Provisional application No. 61/509,309, filed on Jul. 19, 2011.

(52) U.S. Cl.
CPC ..... *E04F 2201/0547* (2013.01); *E04F 2201/0582* (2013.01)

(58) Field of Classification Search
CPC ..... E04F 2201/0153; E04F 2201/0115; E04F 2201/0107; E04F 2201/0552; E04F 2201/0547; E04F 2201/0146; E04F 2201/03
USPC ..... 52/582.1, 582.2, 586.1, 586.2, 585.1
See application file for complete search history.

(56) References Cited

U.S. PATENT DOCUMENTS 124,228 A 3/1872 Stuart
213,740 A 4/1879 Conner
274,354 A 3/1883 McCarthy et al.
316,176 A 4/1885 Ransom
634,581 A 10/1899 Miller
861,911 A 7/1907 Stewart
1,194,636 A 8/1916 Joy
1,723,306 A 8/1929 Sipe
1,743,492 A 1/1930 Sipe
1,809,393 A 6/1931 Rockwell
1,902,716 A 3/1933 Newton
2,026,511 A 12/1935 Storm
2,110,728 A 3/1938 Hoggatt
2,204,675 A 6/1940 Grunert
2,266,464 A 12/1941 Kraft
2,277,758 A 3/1942 Hawkins
2,430,200 A 11/1947 Wilson
2,596,280 A 5/1952 Nystrom
2,732,706 A 1/1956 Friedman
2,740,167 A 4/1956 Rowley
2,858,584 A 11/1958 Gaines
2,863,185 A 12/1958 Riedi
2,865,058 A 12/1958 Andersson
2,889,016 A 6/1959 Warren
3,023,681 A 3/1962 Worson
3,077,703 A 2/1963 Bergstrom
3,099,110 A 7/1963 Spaight
3,147,522 A 9/1964 Schumm
3,187,612 A 6/1965 Hervey
3,271,787 A 9/1966 Clary
3,325,585 A 6/1967 Brenneman
3,331,180 A 7/1967 Vissing et al.
3,378,958 A 4/1968 Parks et al.
3,396,640 A 8/1968 Fujihara
3,512,324 A 5/1970 Reed
3,517,927 A 6/1970 Kennel
3,526,071 A 9/1970 Watanabe
3,535,844 A 10/1970 Glaros
3,572,224 A 3/1971 Perry
3,579,941 A 5/1971 Tibbals
3,720,027 A 3/1973 Christensen
3,722,379 A 3/1973 Koester
3,731,445 A 5/1973 Hoffmann et al.
3,742,669 A 7/1973 Mansfeld
3,760,547 A 9/1973 Brenneman
3,760,548 A 9/1973 Sauer et al.
3,778,954 A 12/1973 Meserole
3,849,235 A 11/1974 Gwynne
3,919,820 A 11/1975 Green
3,950,915 A 4/1976 Cole
3,994,609 A 11/1976 Puccio
4,007,767 A 2/1977 Colledge
4,007,994 A 2/1977 Brown
4,030,852 A 6/1977 Hein
4,037,377 A 7/1977 Howell et al.
4,041,665 A 8/1977 de Munck
4,064,571 A 12/1977 Phipps
4,080,086 A 3/1978 Watson
4,082,129 A 4/1978 Morelock
4,100,710 A 7/1978 Kowallik
4,104,840 A 8/1978 Heintz et al.
4,107,892 A 8/1978 Bellem
4,113,399 A 9/1978 Hansen, Sr. et al.
4,169,688 A 10/1979 Toshio
RE30,154 E 11/1979 Jarvis
4,196,554 A 4/1980 Anderson
4,227,430 A 10/1980 Janssen et al.
4,299,070 A 11/1981 Oltmanns
4,304,083 A 12/1981 Anderson
4,426,820 A 1/1984 Terbrack
4,447,172 A 5/1984 Galbreath
4,512,131 A 4/1985 Laramore
4,599,841 A 7/1986 Haid
4,648,165 A 3/1987 Whitehorne
4,819,932 A 4/1989 Trotter, Jr.
5,007,222 A 4/1991 Raymond
5,026,112 A 6/1991 Rice
5,071,282 A 12/1991 Brown
5,135,597 A 8/1992 Barker
5,148,850 A 9/1992 Urbanick
5,173,012 A 12/1992 Ortwein et al.
5,182,892 A 2/1993 Chase
5,247,773 A 9/1993 Weir
5,272,850 A 12/1993 Mysliwiec et al.
5,274,979 A 1/1994 Tsai
5,295,341 A 3/1994 Kajiwara
5,344,700 A 9/1994 McGath et al.
5,348,778 A 9/1994 Knipp et al.
5,373,674 A 12/1994 Winter, IV
5,465,546 A 11/1995 Buse
5,485,702 A 1/1996 Sholton
5,502,939 A 4/1996 Zadok et al.
5,548,937 A 8/1996 Shimonohara
5,577,357 A 11/1996 Civelli
5,598,682 A 2/1997 Haughian
5,618,602 A 4/1997 Nelson
5,634,309 A 6/1997 Polen
5,658,086 A 8/1997 Brokaw et al.
5,694,730 A 12/1997 Del Rincon et al.
5,755,068 A 5/1998 Ormiston
5,860,267 A 1/1999 Pervan
5,899,038 A 5/1999 Stroppiana
5,910,084 A 6/1999 Koike
5,950,389 A 9/1999 Porter
5,970,675 A 10/1999 Schray
6,006,486 A 12/1999 Moriau
6,029,416 A 2/2000 Andersson
6,052,960 A 4/2000 Yonemura
6,065,262 A 5/2000 Motta
6,173,548 B1 1/2001 Hamar et al.
6,182,410 B1 2/2001 Pervan
6,203,653 B1 3/2001 Seidner
6,210,512 B1 4/2001 Jones
6,254,301 B1 7/2001 Hatch
6,295,779 B1 10/2001 Canfield
6,314,701 B1 11/2001 Meyerson
6,332,733 B1 12/2001 Hamberger
6,339,908 B1 1/2002 Chuang
6,345,481 B1 2/2002 Nelson
6,358,352 B1 3/2002 Schmidt
6,363,677 B1 4/2002 Chen et al.
6,385,936 B1 5/2002 Schneider
6,418,683 B1 7/2002 Martensson et al.
6,446,413 B1 9/2002 Gruber
6,449,918 B1 9/2002 Nelson
6,450,235 B1 9/2002 Lee
6,490,836 B1 12/2002 Moriau et al.
6,505,452 B1 1/2003 Hannig
6,546,691 B2 4/2003 Leopolder
6,553,724 B1 4/2003 Bigler
6,576,079 B1 6/2003 Kai
6,584,747 B2 7/2003 Kettler et al.

(56) References Cited

U.S. PATENT DOCUMENTS 6,591,568 B1 7/2003 Pålsson
6,601,359 B2 * 8/2003 Olofsson ..... E04F 13/16 52/588.1
6,617,009 B1 9/2003 Chen et al.
6,647,689 B2 11/2003 Pletzer et al.
6,647,690 B1 11/2003 Martensson
6,651,400 B1 11/2003 Murphy
6,670,019 B2 12/2003 Andersson
6,672,030 B2 1/2004 Schulte
6,681,820 B2 1/2004 Olofsson
6,684,592 B2 * 2/2004 Martin ..... A63C 19/00 403/331
6,685,391 B1 2/2004 Gideon
6,729,091 B1 5/2004 Martensson
6,763,643 B1 7/2004 Martensson
6,766,622 B1 7/2004 Thiers
6,769,219 B2 8/2004 Schwitte et al.
6,769,835 B2 8/2004 Stridsman
6,802,166 B1 10/2004 Durnberger
6,804,926 B1 10/2004 Eisermann
6,808,777 B2 10/2004 Andersson et al.
6,854,235 B2 2/2005 Martensson
6,862,857 B2 3/2005 Tychsen
6,865,855 B2 3/2005 Knauseder
6,874,291 B1 4/2005 Weber
6,880,307 B2 4/2005 Schwitte et al.
6,948,716 B2 9/2005 Drouin
7,021,019 B2 4/2006 Knauseder
7,040,068 B2 5/2006 Moriau et al.
7,051,486 B2 5/2006 Pervan
7,108,031 B1 9/2006 Secrest
7,121,058 B2 10/2006 Pålsson
7,152,383 B1 12/2006 Wilkinson et al.
7,188,456 B2 3/2007 Knauseder
7,219,392 B2 5/2007 Mullet et al.
7,251,916 B2 8/2007 Konzelmann et al.
7,257,926 B1 8/2007 Kirby
7,337,588 B1 3/2008 Moebus
7,377,081 B2 5/2008 Ruhdorfer
7,451,578 B2 11/2008 Hannig
7,454,875 B2 11/2008 Pervan et al.
7,516,588 B2 4/2009 Pervan
7,517,427 B2 4/2009 Sjoberg et al.
7,533,500 B2 5/2009 Morton et al.
7,556,849 B2 7/2009 Thompson et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,644,553 B2 1/2010 Knauseder
7,654,055 B2 2/2010 Ricker
7,677,005 B2 3/2010 Pervan
7,716,889 B2 5/2010 Pervan
7,721,503 B2 5/2010 Pervan et al.
7,726,088 B2 6/2010 Muehlebach
7,757,452 B2 7/2010 Pervan
7,802,411 B2 9/2010 Pervan
7,806,624 B2 10/2010 McLean et al.
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,954,295 B2 6/2011 Pervan
7,980,039 B2 7/2011 Groeke
7,980,041 B2 7/2011 Pervan
8,006,458 B1 8/2011 Olofsson et al.
8,033,074 B2 10/2011 Pervan
8,042,311 B2 10/2011 Pervan
8,061,104 B2 11/2011 Pervan
8,079,196 B2 12/2011 Pervan
8,112,967 B2 2/2012 Pervan et al.
8,171,692 B2 5/2012 Pervan
8,181,416 B2 5/2012 Pervan et al.
8,191,334 B2 6/2012 Braun
8,220,217 B2 * 7/2012 Muehlebach ..... E04F 15/02 403/320
8,234,830 B2 8/2012 Pervan et al.
8,245,478 B2 8/2012 Bergelin
8,281,549 B2 10/2012 Du
8,302,367 B2 11/2012 Schulte
8,336,272 B2 12/2012 Prager et al.
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,375,673 B2 2/2013 Evjen
8,381,476 B2 * 2/2013 Hannig ..... E04F 15/02 428/50
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,511,031 B2 8/2013 Bergelin et al.
8,522,505 B2 * 9/2013 Beach ..... E04B 5/023 403/286
8,528,289 B2 9/2013 Pervan et al.
8,544,230 B2 10/2013 Pervan
8,544,234 B2 10/2013 Pervan et al.
8,572,922 B2 11/2013 Pervan
8,578,675 B2 11/2013 Palsson et al.
8,596,013 B2 12/2013 Boo
8,615,952 B2 12/2013 Engström
8,627,862 B2 1/2014 Pervan et al.
8,631,623 B2 1/2014 Engström
8,635,829 B2 * 1/2014 Schulte ..... E04F 13/08 52/581
8,640,424 B2 2/2014 Pervan et al.
8,650,826 B2 2/2014 Pervan et al.
8,677,714 B2 3/2014 Pervan
8,689,512 B2 4/2014 Pervan
8,701,368 B2 4/2014 Vermeulen
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,887,468 B2 11/2014 Hakansson et al.
8,898,988 B2 12/2014 Pervan
8,925,274 B2 1/2015 Pervan et al.
8,938,929 B2 1/2015 Engström
8,959,866 B2 2/2015 Pervan
8,973,331 B2 3/2015 Boo
8,991,055 B2 * 3/2015 Cappelle ..... E04F 15/02 29/897.3
8,997,423 B2 * 4/2015 Mann ..... E04C 2/38 52/477
9,027,306 B2 5/2015 Pervan
9,051,738 B2 6/2015 Pervan et al.
9,068,360 B2 6/2015 Pervan
9,091,077 B2 7/2015 Boo
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan

(56) References Cited

U.S. PATENT DOCUMENTS 9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan
9,458,634 B2 10/2016 Derelov
9,482,012 B2 11/2016 Nygren et al.
9,540,826 B2 1/2017 Pervan et al.
9,663,940 B2 5/2017 Boo
9,725,912 B2 8/2017 Pervan
2001/0024707 A1 9/2001 Andersson et al.
2001/0045150 A1 11/2001 Owens
2002/0031646 A1 3/2002 Chen et al.
2002/0069611 A1 6/2002 Leopolder
2002/0092263 A1 7/2002 Schulte
2002/0095894 A1* 7/2002 Pervan ..... E04F 15/02 52/391
2002/0108343 A1 8/2002 Knauseder
2002/0170258 A1 11/2002 Schwitte et al.
2002/0170259 A1 11/2002 Ferris
2002/0178674 A1 12/2002 Pervan
2002/0178680 A1 12/2002 Martensson
2002/0189190 A1 12/2002 Charmat et al.
2002/0194807 A1 12/2002 Nelson et al.
2003/0009971 A1 1/2003 Palmberg
2003/0024199 A1 2/2003 Pervan et al.
2003/0037504 A1 2/2003 Schwitte et al.
2003/0084636 A1 5/2003 Pervan
2003/0094230 A1 5/2003 Sjoberg
2003/0101681 A1 6/2003 Tychsen
2003/0145549 A1 8/2003 Palsson et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0049999 A1 3/2004 Krieger
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0139676 A1 7/2004 Knauseder
2004/0139678 A1 7/2004 Pervan
2004/0159066 A1 8/2004 Thiers et al.
2004/0168392 A1 9/2004 Konzelmann et al.
2004/0177584 A1 9/2004 Pervan
2004/0182033 A1 9/2004 Wernersson
2004/0182036 A1 9/2004 Sjoberg et al.
2004/0200175 A1 10/2004 Weber
2004/0211143 A1 10/2004 Hannig
2004/0244325 A1 12/2004 Nelson
2004/0250492 A1 12/2004 Becker
2004/0261348 A1 12/2004 Vulin
2005/0003132 A1 1/2005 Blix et al.
2005/0028474 A1 2/2005 Kim
2005/0050827 A1 3/2005 Schitter
2005/0160694 A1 7/2005 Pervan
2005/0166514 A1 8/2005 Pervan
2005/0205161 A1 9/2005 Lewark
2005/0210810 A1 9/2005 Pervan
2005/0235593 A1 10/2005 Hecht
2005/0252130 A1 11/2005 Martensson
2005/0268570 A2 12/2005 Pervan
2006/0053724 A1 3/2006 Braun et al.
2006/0070333 A1 4/2006 Pervan
2006/0101769 A1 5/2006 Pervan
2006/0156670 A1 7/2006 Knauseder
2006/0174577 A1 8/2006 O'Neil
2006/0179754 A1 8/2006 Yang
2006/0236642 A1 10/2006 Pervan
2006/0260254 A1 11/2006 Pervan et al.
2006/0272262 A1 12/2006 Pomberger
2007/0006543 A1 1/2007 Engström
2007/0011981 A1 1/2007 Eiserman
2007/0028547 A1* 2/2007 Grafenauer ..... E04F 13/10 52/586.1
2007/0065293 A1 3/2007 Hannig
2007/0108679 A1 5/2007 Grothaus
2007/0151189 A1 7/2007 Yang et al.
2007/0175156 A1 8/2007 Pervan et al.
2007/0193178 A1 8/2007 Groeke et al.
2007/0209736 A1 9/2007 Deringor et al.
2007/0214741 A1 9/2007 Llorens Miravet
2008/0000182 A1 1/2008 Pervan
2008/0000185 A1 1/2008 Duernberger
2008/0000186 A1 1/2008 Pervan et al.
2008/0000187 A1 1/2008 Pervan et al.
2008/0005998 A1 1/2008 Pervan
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0053029 A1 3/2008 Ricker
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0184646 A1* 8/2008 Alford ..... E04F 13/14 52/582.1
2008/0216434 A1 9/2008 Pervan
2008/0216920 A1 9/2008 Pervan
2008/0236088 A1 10/2008 Hannig et al.
2008/0295432 A1 12/2008 Pervan et al.
2008/0302044 A1 12/2008 Johansson
2009/0019806 A1 1/2009 Muehlebach
2009/0064624 A1 3/2009 Sokol
2009/0100782 A1* 4/2009 Groeke ..... E04F 15/02 52/589.1
2009/0133353 A1 5/2009 Pervan et al.
2009/0151290 A1 6/2009 Liu
2009/0173032 A1 7/2009 Prager et al.
2009/0193741 A1 8/2009 Capelle
2009/0193748 A1 8/2009 Boo et al.
2009/0193753 A1 8/2009 Schitter
2009/0217615 A1 9/2009 Engstrom
2009/0241460 A1 10/2009 Beaulieu
2009/0308014 A1 12/2009 Muehlebach
2010/0043333 A1 2/2010 Hannig et al.
2010/0083603 A1 4/2010 Goodwin
2010/0170189 A1 7/2010 Schulte
2010/0173122 A1 7/2010 Susnjara
2010/0281803 A1 11/2010 Cappelle
2010/0293879 A1 11/2010 Pervan et al.
2010/0300029 A1 12/2010 Braun et al.
2010/0300031 A1 12/2010 Pervan et al.
2010/0319290 A1 12/2010 Pervan
2010/0319291 A1 12/2010 Pervan et al.
2011/0016815 A1 1/2011 Yang
2011/0030303 A1 2/2011 Pervan et al.
2011/0041996 A1 2/2011 Pervan
2011/0047922 A1 3/2011 Fleming, III
2011/0088344 A1 4/2011 Pervan et al.
2011/0088345 A1 4/2011 Pervan
2011/0088346 A1 4/2011 Hannig
2011/0131916 A1 6/2011 Chen
2011/0154763 A1 6/2011 Bergelin et al.
2011/0162312 A1 7/2011 Schulte
2011/0167750 A1 7/2011 Pervan
2011/0167751 A1 7/2011 Engström
2011/0173914 A1 7/2011 Engström
2011/0197535 A1 8/2011 Baker et al.
2011/0225921 A1 9/2011 Schulte
2011/0225922 A1 9/2011 Pervan et al.
2011/0252733 A1 10/2011 Pervan
2011/0271631 A1 11/2011 Engstrom
2011/0271632 A1 11/2011 Cappelle et al.
2011/0283650 A1 11/2011 Pervan et al.
2012/0017533 A1 1/2012 Pervan et al.
2012/0031029 A1 2/2012 Pervan et al.

(56) References Cited

U.S. PATENT DOCUMENTS

| | | | |
|---|---|---|---|
| 2012/0036804 | A1 | 2/2012 | Pervan |
| 2012/0042598 | A1 | 2/2012 | Vermeulen et al. |
| 2012/0055112 | A1 | 3/2012 | Engström |
| 2012/0124932 | A1 | 5/2012 | Schulte et al. |
| 2012/0151865 | A1 | 6/2012 | Pervan et al. |
| 2012/0174515 | A1 | 7/2012 | Pervan |
| 2012/0174519 | A1 | 7/2012 | Schulte |
| 2012/0174520 | A1 | 7/2012 | Pervan |
| 2012/0174521 | A1 | 7/2012 | Schulte et al. |
| 2012/0192521 | A1 | 8/2012 | Schulte |
| 2012/0279161 | A1 | 11/2012 | Håkansson et al. |
| 2012/0304590 | A1 | 12/2012 | Engström |
| 2013/0008117 | A1 | 1/2013 | Pervan |
| 2013/0008118 | A1 | 1/2013 | Baert et al. |
| 2013/0014463 | A1 | 1/2013 | Pervan |
| 2013/0019555 | A1 | 1/2013 | Pervan |
| 2013/0025231 | A1 | 1/2013 | Vermeulen et al. |
| 2013/0042562 | A1 | 2/2013 | Pervan |
| 2013/0042563 | A1 | 2/2013 | Pervan |
| 2013/0042564 | A1 | 2/2013 | Pervan et al. |
| 2013/0042565 | A1 | 2/2013 | Pervan |
| 2013/0047536 | A1 | 2/2013 | Pervan |
| 2013/0081349 | A1 | 4/2013 | Pervan et al. |
| 2013/0111837 | A1 | 5/2013 | Devos et al. |
| 2013/0111845 | A1 | 5/2013 | Pervan |
| 2013/0145708 | A1 | 6/2013 | Pervan |
| 2013/0152500 | A1 | 6/2013 | Engström |
| 2013/0160391 | A1 | 6/2013 | Pervan et al. |
| 2013/0167467 | A1 | 7/2013 | Vermeulen et al. |
| 2013/0219806 | A1 | 8/2013 | Carrubba |
| 2013/0232905 | A2 | 9/2013 | Pervan |
| 2013/0239508 | A1 | 9/2013 | Pervan et al. |
| 2013/0263454 | A1 | 10/2013 | Boo et al. |
| 2013/0263547 | A1 | 10/2013 | Boo |
| 2013/0283719 | A1 | 10/2013 | Döhring et al. |
| 2013/0318906 | A1 | 12/2013 | Pervan et al. |
| 2014/0007539 | A1 | 1/2014 | Pervan et al. |
| 2014/0020324 | A1 | 1/2014 | Pervan |
| 2014/0026513 | A1 | 1/2014 | Bishop |
| 2014/0033634 | A1 | 2/2014 | Pervan |
| 2014/0053497 | A1 | 2/2014 | Pervan et al. |
| 2014/0059966 | A1 | 3/2014 | Boo |
| 2014/0069043 | A1 | 3/2014 | Pervan |
| 2014/0090335 | A1 | 4/2014 | Pervan et al. |
| 2014/0109501 | A1 | 4/2014 | Pervan |
| 2014/0109506 | A1 | 4/2014 | Pervan et al. |
| 2014/0123586 | A1 | 5/2014 | Pervan et al. |
| 2014/0130437 | A1 | 5/2014 | Cappelle |
| 2014/0144096 | A1* | 5/2014 | Vermeulen ..... E04F 15/02038 52/582.2 |
| 2014/0150369 | A1 | 6/2014 | Hannig |
| 2014/0190112 | A1 | 7/2014 | Pervan |
| 2014/0208677 | A1 | 7/2014 | Pervan et al. |
| 2014/0223852 | A1 | 8/2014 | Pervan |
| 2014/0237931 | A1 | 8/2014 | Pervan |
| 2014/0250813 | A1 | 9/2014 | Nygren et al. |
| 2014/0260060 | A1 | 9/2014 | Pervan et al. |
| 2014/0283466 | A1 | 9/2014 | Boo |
| 2014/0305065 | A1 | 10/2014 | Pervan |
| 2014/0366476 | A1 | 12/2014 | Pervan |
| 2014/0373478 | A2 | 12/2014 | Pervan et al. |
| 2014/0373480 | A1 | 12/2014 | Pervan et al. |
| 2015/0000221 | A1 | 1/2015 | Boo |
| 2015/0013260 | A1 | 1/2015 | Pervan |
| 2015/0047284 | A1 | 2/2015 | Cappelle |
| 2015/0059281 | A1 | 3/2015 | Pervan |
| 2015/0089896 | A2 | 4/2015 | Pervan et al. |
| 2015/0121796 | A1 | 5/2015 | Pervan |
| 2015/0152644 | A1 | 6/2015 | Boo |
| 2015/0167318 | A1 | 6/2015 | Pervan |
| 2015/0176619 | A1 | 6/2015 | Baker |
| 2015/0211239 | A1 | 7/2015 | Pervan |
| 2015/0233125 | A1 | 8/2015 | Pervan et al. |
| 2015/0267419 | A1 | 9/2015 | Pervan |
| 2015/0300029 | A1 | 10/2015 | Pervan |
| 2015/0330088 | A1 | 11/2015 | Derelov |
| 2015/0337537 | A1 | 11/2015 | Boo |
| 2015/0337542 | A1 | 11/2015 | Cappelle et al. |
| 2016/0032596 | A1 | 2/2016 | Nygren et al. |
| 2016/0060879 | A1 | 3/2016 | Pervan |
| 2016/0069088 | A1 | 3/2016 | Boo et al. |
| 2016/0076260 | A1 | 3/2016 | Pervan et al. |
| 2016/0090744 | A1 | 3/2016 | Pervan et al. |
| 2016/0153200 | A1 | 6/2016 | Pervan |
| 2016/0186426 | A1 | 6/2016 | Boo |
| 2016/0194884 | A1 | 7/2016 | Pervan et al. |
| 2016/0201336 | A1 | 7/2016 | Pervan |
| 2016/0251859 | A1 | 9/2016 | Pervan et al. |
| 2016/0251860 | A1 | 9/2016 | Pervan |
| 2016/0281368 | A1 | 9/2016 | Pervan et al. |
| 2016/0281370 | A1 | 9/2016 | Pervan et al. |
| 2016/0326751 | A1 | 11/2016 | Pervan |
| 2016/0340913 | A1 | 11/2016 | Derelöv |
| 2017/0037641 | A1 | 2/2017 | Nygren et al. |
| 2017/0081860 | A1 | 3/2017 | Boo |

FOREIGN PATENT DOCUMENTS

| | | | |
|---|---|---|---|
| DE | 138 992 | C | 7/1901 |
| DE | 142 293 | C | 7/1902 |
| DE | 2 159 042 | | 6/1973 |
| DE | 25 05 489 | A1 | 8/1976 |
| DE | 33 43 601 | A1 | 6/1985 |
| DE | 33 43 601 | C2 | 6/1985 |
| DE | 39 32 980 | A1 | 11/1991 |
| DE | 45 15 273 | A1 | 11/1993 |
| DE | 42 42 530 | A1 | 6/1994 |
| DE | 196 01 322 | A | 5/1997 |
| DE | 299 22 649 | U1 | 4/2000 |
| DE | 200 01 788 | U1 | 6/2000 |
| DE | 200 02 744 | U1 | 8/2000 |
| DE | 199 40 837 | A1 | 11/2000 |
| DE | 10 2006 057 491 | A1 | 1/2001 |
| DE | 199 58 225 | A1 | 6/2001 |
| DE | 202 05 774 | U1 | 8/2002 |
| DE | 10 2009 048 050 | B3 | 1/2003 |
| DE | 203 20 799 | U1 | 4/2005 |
| DE | 10 2004 055 951 | A1 | 7/2005 |
| DE | 10 2004 001 363 | A1 | 8/2005 |
| DE | 10 2004 054 368 | A1 | 5/2006 |
| DE | 10 2005 024 366 | A1 | 5/2006 |
| DE | 10 2006 024 184 | A1 | 11/2007 |
| DE | 10 2006 037 614 | B3 | 12/2007 |
| DE | 10 2007 018 309 | A1 | 8/2008 |
| DE | 10 2007 016 533 | A1 | 10/2008 |
| DE | 10 2007 032 885 | A1 | 1/2009 |
| DE | 10 2007 035 648 | A1 | 1/2009 |
| DE | 10 2007 049 792 | A1 | 2/2009 |
| DE | 10 2009 041 297 | A1 | 3/2011 |
| EP | 0 013 852 | A1 | 8/1980 |
| EP | 0 871 156 | A2 | 10/1998 |
| EP | 0 974 713 | A1 | 1/2000 |
| EP | 1 120 515 | A1 | 8/2001 |
| EP | 1 146 182 | A2 | 10/2001 |
| EP | 1 251 219 | A | 10/2002 |
| EP | 1 350 904 | A2 | 10/2003 |
| EP | 1 350 904 | A3 | 10/2003 |
| EP | 1 420 125 | A2 | 5/2004 |
| EP | 1 437 457 | A2 | 7/2004 |
| EP | 1 640 530 | A2 | 3/2006 |
| EP | 1 650 375 | A1 | 4/2006 |
| EP | 1 650 375 | A8 | 9/2006 |
| EP | 1 980 683 | A2 | 10/2008 |
| EP | 2 017 403 | A2 | 1/2009 |
| EP | 2 034 106 | A1 | 3/2009 |
| EP | 2 063 045 | A2 | 5/2009 |
| EP | 2 078 801 | A1 | 7/2009 |
| EP | 2 236 694 | A1 | 10/2010 |
| EP | 2 270 291 | A1 | 1/2011 |
| EP | 2 270 291 | B1 | 5/2011 |
| EP | 2 333 195 | A1 | 6/2011 |
| EP | 2 388 409 | A2 | 11/2011 |
| EP | 2 395 179 | A2 | 12/2011 |
| EP | 2 078 801 | B1 | 3/2012 |

(56) References Cited

FOREIGN PATENT DOCUMENTS

| | | | |
|---|---|---|---|
| EP | 2 570 564 | A2 | 3/2013 |
| FR | 1.138.595 | | 6/1957 |
| FR | 2 256 807 | | 8/1975 |
| FR | 2 810 060 | A1 | 12/2001 |
| GB | 240629 | | 10/1925 |
| GB | 376352 | | 7/1932 |
| GB | 1171337 | | 11/1969 |
| GB | 2 051 916 | A | 1/1981 |
| JP | 03-110258 | A | 5/1991 |
| JP | 05-018028 | A | 1/1993 |
| JP | 6-146553 | A | 5/1994 |
| JP | 6-288017 | A | 10/1994 |
| JP | 6-306961 | A | 11/1994 |
| JP | 6-322848 | A | 11/1994 |
| JP | 7-300979 | A | 11/1995 |
| SE | 526 688 | C2 | 5/2005 |
| SE | 529 076 | C2 | 4/2007 |
| WO | WO 94/26999 | A1 | 11/1994 |
| WO | WO 96/23942 | A1 | 8/1996 |
| WO | WO 96/27721 | A1 | 9/1996 |
| WO | WO 97/47834 | A1 | 12/1997 |
| WO | WO 98/21428 | A1 | 5/1998 |
| WO | WO 98/22677 | A1 | 5/1998 |
| WO | WO 98/58142 | A1 | 12/1998 |
| WO | WO 99/66151 | A1 | 12/1999 |
| WO | WO 99/66152 | A1 | 12/1999 |
| WO | WO 00/20705 | A1 | 4/2000 |
| WO | WO 00/20706 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/02672 | A1 | 1/2001 |
| WO | WO 01/07729 | A1 | 2/2001 |
| WO | WO 01/38657 | A1 | 5/2001 |
| WO | WO 01/44669 | A2 | 6/2001 |
| WO | WO 01/44669 | A3 | 6/2001 |
| WO | WO 01/48331 | A1 | 7/2001 |
| WO | WO 01/48332 | A1 | 7/2001 |
| WO | WO 01/51732 | A1 | 7/2001 |
| WO | WO 01/51733 | A1 | 7/2001 |
| WO | WO 01/66877 | A1 | 9/2001 |
| WO | WO 01/75247 | A1 | 10/2001 |
| WO | WO 01/77461 | A1 | 10/2001 |
| WO | WO 01/94721 | A1 | 12/2001 |
| WO | WO 01/94721 | A8 | 12/2001 |
| WO | WO 01/98604 | A1 | 12/2001 |
| WO | WO 02/48127 | | 6/2002 |
| WO | WO 02/055809 | A1 | 7/2002 |
| WO | WO 02/055810 | A1 | 7/2002 |
| WO | WO 02/081843 | A1 | 10/2002 |
| WO | WO 02/103135 | A1 | 12/2002 |
| WO | WO 03/012224 | A1 | 2/2003 |
| WO | WO 03/016654 | A1 | 2/2003 |
| WO | WO 03/025307 | A1 | 3/2003 |
| WO | WO 03/038210 | A1 | 5/2003 |
| WO | WO 03/044303 | A1 | 5/2003 |
| WO | WO 03/069094 | A1 | 8/2003 |
| WO | WO 03/074814 | A1 | 9/2003 |
| WO | WO 03/083234 | A1 | 10/2003 |
| WO | WO 03/087497 | A1 | 10/2003 |
| WO | WO 03/089736 | A1 | 10/2003 |
| WO | WO 2004/016877 | A1 | 2/2004 |
| WO | WO 2004/020764 | A1 | 3/2004 |
| WO | WO 2004/048716 | A1 | 6/2004 |
| WO | WO 2004/050780 | A2 | 6/2004 |
| WO | WO 2004/079128 | A1 | 9/2004 |
| WO | WO 2004/079130 | A1 | 9/2004 |
| WO | WO 2004/083557 | A1 | 9/2004 |
| WO | WO 2004/085765 | A1 | 10/2004 |
| WO | WO 2005/003488 | A1 | 1/2005 |
| WO | WO 2005/003489 | A1 | 1/2005 |
| WO | WO 2005/054599 | A1 | 6/2005 |
| WO | 10 2005 002 297 | A1 | 8/2005 |
| WO | WO 2006/043893 | A1 | 4/2006 |
| WO | WO 2006/050928 | A1 | 5/2006 |
| WO | WO 2006/104436 | A1 | 10/2006 |
| WO | WO 2006/123988 | A1 | 11/2006 |
| WO | WO 2006/125646 | A1 | 11/2006 |
| WO | WO 2007/015669 | A2 | 2/2007 |
| WO | WO 2007/015669 | A3 | 2/2007 |
| WO | WO 2007/019957 | A1 | 2/2007 |
| WO | WO 2007/079845 | A1 | 7/2007 |
| WO | WO 2007/089186 | A1 | 8/2007 |
| WO | WO 2007/118352 | A1 | 10/2007 |
| WO | WO 2007/141605 | A2 | 12/2007 |
| WO | WO 2007/142589 | A1 | 12/2007 |
| WO | WO 2008/004960 | A2 | 1/2008 |
| WO | WO 2008/004960 | A3 | 1/2008 |
| WO | WO 2008/004960 | A8 | 1/2008 |
| WO | WO 2008/017281 | A1 | 2/2008 |
| WO | WO 2008/017301 | A2 | 2/2008 |
| WO | WO 2008/017301 | A3 | 2/2008 |
| WO | WO 2008/060232 | A1 | 5/2008 |
| WO | WO 2008/068245 | A1 | 6/2008 |
| WO | WO 2008/116623 | A1 | 10/2008 |
| WO | 2 000 610 | A1 | 12/2008 |
| WO | WO 2009/013590 | A2 | 1/2009 |
| WO | WO 2009/066153 | A2 | 5/2009 |
| WO | WO 2009/116926 | A1 | 9/2009 |
| WO | WO 2010/006684 | A2 | 1/2010 |
| WO | WO 2010/028621 | A1 | 3/2010 |
| WO | WO 2010/070472 | A2 | 6/2010 |
| WO | WO 2010/070472 | A3 | 6/2010 |
| WO | WO 2010/070605 | A2 | 6/2010 |
| WO | WO 2010/082171 | A2 | 7/2010 |
| WO | WO 2010/087752 | A1 | 8/2010 |
| WO | WO 2010/105732 | A1 | 9/2010 |
| WO | WO 2010/108980 | A1 | 9/2010 |
| WO | WO 2010/136171 | A1 | 12/2010 |
| WO | WO 2011/001326 | A2 | 1/2011 |
| WO | WO 2011/012104 | A2 | 2/2011 |
| WO | WO 2011/012105 | A1 | 2/2011 |
| WO | WO 2011/032540 | A2 | 3/2011 |
| WO | WO 2011/038709 | A1 | 4/2011 |
| WO | WO 2011/085788 | A1 | 7/2011 |
| WO | WO 2011/127981 | A1 | 10/2011 |
| WO | WO 2011/151758 | A2 | 12/2011 |
| WO | WO 2011/151758 | A3 | 12/2011 |
| WO | WO 2013/012386 | A1 | 1/2013 |
| WO | WO 2013/025164 | A1 | 2/2013 |
| WO | WO 2013/087190 | A1 | 6/2013 |
| WO | WO 2013/151493 | A1 | 10/2013 |

OTHER PUBLICATIONS

U.S. Appl. No. 13/544,281, Darko Pervan, filed Jul. 9, 2012.
U.S. Appl. No. 14/046,235, Darko Pervan, Niclas Håkansson and Per Nygren, filed Oct. 4, 2013.
U.S. Appl. No. 14/206,286, Darko Pervan and Marcus Bergelin, filed Mar. 12, 2014.
U.S. Appl. No. 14/258,742, Darko Pervan, filed Apr. 22, 2014.
U.S. Appl. No. 14/294,230, Darko Pervan and Agne Pålsson, filed Jun. 3, 2014.
U.S. Appl. No. 14/315,879, Christian Boo, filed Jun. 26, 2014.
U.S. Appl. No. 14/463,972, Darko Pervan and Agne Pålsson, filed Aug. 20, 2014.
U.S. Appl. No. 14/503,780, Darko Pervan, filed Oct. 1, 2014.
U.S. Appl. No. 14/538,223, Darko Pervan, filed Nov. 11, 2014.
U.S. Appl. No. 14/597,578, Darko Pervan, filed Jan. 15, 2015.
U.S. Appl. No. 14/633,480, Darko Pervan, filed Feb. 27, 2015.
U.S. Appl. No. 14/701,959, Darko Pervan and Tony Pervan, filed May 1, 2015.
U.S. Appl. No. 14/709,913, Peter Derelov, filed May 12, 2015.
U.S. Appl. No. 14/646,567, Darko Pervan, filed May 21, 2015.
U.S. Appl. No. 14/730,691, Darko Pervan, filed Jun. 4, 2015.
U.S. Appl. No. 14/938,612, Darko Pervan, filed Nov. 11, 2015.
U.S. Appl. No. 14/962,291, Darko Pervan, Niclas Håkansson and Per Nygren, filed Dec. 8, 2015.

(56) References Cited

OTHER PUBLICATIONS

U.S. Appl. No. 14/951,976, Darko Pervan, filed Nov. 25, 2015.
U.S. Appl. No. 15/148,820, Darko Pervan, filed May 6, 2016.
U.S. Appl. No. 14/951,976, Pervan.
U.S. Appl. No. 15/148,820, Pervan.
International Search Report dated Oct. 15, 2012 in PCT/SE2012/050828, Swedish Patent Office, Stockholm, Sweden, 7 pages.
Välinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.
Engstrand, Ola (Contact)/Välinge Innovation AB, Technical Disclosure entitled "VA-038 Mechanical Locking of Floor Panels With Vertical Folding," IP com No. IPCOM000179246D, Feb. 10, 2009, IP.com Prior Art Database, 59 pages.
Engstrand, Ola (Contact)/Välinge Innovation AB, Technical Disclosure entitled "VA043 5G Linear Slide Tongue," IP com No. IPCOM000179015D, Feb. 4, 2009, IP.com Prior Art Database, 126 pages.
Engstrand, Ola (Owner)/Välinge Innovation AB, Technical Disclosure entitled "VA043b PCT Mechanical Locking of Floor Panels," IP com No. IPCOM000189420D, Nov. 9, 2009, IP.com Prior Art Database, 62 pages.
Engstrand, Ola (Contact)/Välinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Välinge Innovation AB, Technical Disclosure entitled "VA058 Rocker Tongue," IP com No. IPCOM000203832D, Feb. 4, 2011, Ip.com Prior Art Database, 22 pages.
Pervan, Darko (Author)/Välinge Flooring Technology, Technical Disclosure entitled "VA066b Glued Tongue," IP com No. IPCOM000210865D, Sep. 13, 2011, IP.com Prior Art Database, 19 pages.
Pervan, Darko (Inventor)/Välinge Flooring Technology AB, Technical Disclosure entitled "VA067 Fold Slide Loc," IP com No. IPCOM000208542D, Jul. 12, 2011, IP.com Prior Art Database, 37 pages.
Pervan, Darko (Author)/Välinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "VA069 Combi Tongue," IP com No. IPCOM000210866D, Sep. 13, 2011, IP.com Prior Art Database, 41 pages.
Pervan, Darko (Author), Technical Disclosure entitled "VA070 Strip Part," IP com No. IPCOM000210867D, Sep. 13, 2011, IP.com Prior Art Database, 43 pages.
Pervan, Darko (Author), Technical Disclosure entitled "VA071 Pull Lock," IP com No. IPCOM000210868D, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Complaint by *Välinge Flooring Technology AB, Välinge Flooring Technology AB gegen Spanolux N.V. Divisie Balterio*, Jan. 7, 2013, 144 pages, Grünecker Patent—und Rechtsanwälte, München, DE (with machine translation of Complaint and with Attachments ("Anlage"): Anlage K1, Anlage K 2, Anlage 2a, Anlage K3, Anlage K4, Anlage K5, Anlage K6, Anlage K7 and Anlage K9).
Court Order, *Verfügung im Rechtsstreit Välinge Flooring gegen Spanolux N.V.*, Jan. 9, 2013, 2 pages, Landgericht Mannheim, Mannheim, DE.
Reply by *Spanolux N.V. Divisie Balterio, Välinge Flooring Technology AB gegen Spanolux N.V. Divisie Balterio*, Mar. 12, 2013, 675 pages, Bird & Bird LLP, Dusseldorf, DE (with machine translation of Reply; and with Attachments ("Anlage"): Anlage B1, Anlage B2, Anlage B3, Anlage B4, Anlage B5, Anlage B7, Anlage B8, Anlage B9, Anlage B10, Anlage B11, Anlage B12, Anlage B13, Anlage B14, Anlage B15, Anlage B16, Anlage B17, Anlage B18, Anlage B18a, Anlage B19, Anlage B20, Anlage B21, Anlage B21a, Anlage B22, Anlage B22a, Anlage B23, Anlage B23a, Anlage B24, Anlage B25, Anlage B26, Anlage B26a, Anlage B27, Anlage B28, Anlage B29, Anlage B30, Anlage B31, Anlage B32, Anlage B33, Anlage B34, Anlage B35 and Anlage B36).
Reply by *Valinge Flooring Technology AB, Valinge Flooring Technology AB gegen Spanolux N.V. Divisie Balterio* , Jul. 3, 2013, 107 pages, Grünecker Patent—und Rechtsanwalte, München, DE (with machine translation of Reply; and with Attachments ("Anlage"): Anlage K10, Anlage K10a, Anlage K11, Anlage K12, Anlage K13, Anlage K14, Anlage K15, Anlage K16, Anlage K16a and Anlage K17).
Reply by *Spanolux N.V. Divisie Balterio, Välinge Flooring Technology AB gegen Spanolux N.V. Divisie Balterio*, Sep. 17, 2013, 833 pages, Bird & Bird LLP, Dusseldorf, DE (with machine translation of Reply, and with Attachments ("Anlage"): Anlage B37, Anlage B38, Anlage B39, Anlage B40, Anlage B43, Anlage B44, Anlage B45, Anlage B45a, Anlage B46, Anlage B47, Anlage B56, Anlage B58, Anlage B59, Anlage B60, Anlage B83, Anlage B85, Anlage B85a, Anlage B85b, Anlage B85c, Anlage B86, Anlage B87 and Anlage B18b, Anlage B25b, Anlage B26b, Anlage B41, Anlage B42, Anlage B48, Anlage B49, Anlage B49a, Anlage B50, Anlage B51, Anlage B52, Anlage B53, Anlage B54, Anlage B55, Anlage B57, Anlage B61, Anlage B62, Anlage B63, Anlage B63a, Anlage B64, Anlage B65, Anlage 866, Anlage B67, Anlage B68, Anlage 869, Anlage B70, Anlage B71, Anlage B72, Anlage B72a, Anlage B73, Anlage B74, Anlage B75, Anlage B75a, Anlage B76, Anlage B77, Anlage B78, Anlage B79, Anlage B80, Anlage B81 and Anlage B82).
Reply by *Välinge Flooring Technology AB, Valinge Flooring Technology AB gegen Spanolux N.V. Divisie Balterio*, Sep. 23, 2013, 41 pages, Grünecker Patent—und Rechtsanwälte, München, DE (with machine translation of Reply).
"Balterio introduces the new fold down installation system PXP®." News [online]. Balterio Corporation, 2011 [retrieved on Nov. 7, 2013]. Retrieved from the Internet: <URL: http://www.balterio.com/gb/en/news/359 >.
Spanolux N.V. -DIV. Balterio, Priority Document for EP 11007573, dated Sep. 16, 2011, 20 pages, European Patent Office.
(Human) English-language translation of paragraphs 211-214 of Reply by *Spanolux N.V. Divisie Balterio, Välinge Flooring Technology AB gegen Spanolux N.V. Divisie Balterio*, Bird & Bird LLP, Dusseldorf, DE.
Correspondence from German Patent and Trademark Office to Grunecker, Kinkeldey, Stockmair & Schwanhäusse forwarding cancellation request, Nov. 11, 2013, 2 pages.
Cancellation Request by *Spanolux N.V. Divisie Balterio, Inhaberin: Välinge Flooring Technology AB, Antragstellerin: Spanolux N.V. Divisie Balterio*, Oct. 31, 2013, 75 pages, Bird & Bird LLP, Dusseldorf, DE.
LifeTips, "Laminate Flooring Tips," available at (http://flooring.lifetips.com/cat/61734/laminate-flooring-tips/index.html), 2000, 12 pages.
Pervan, Darko, U.S. Appl. No. 14/951,976, entitled "Mechanical Locking System for Floor Panels," filed in the U.S. Patent and Trademark Office Nov. 25, 2015.
Pervan, Darko, U.S. Appl. No. 15/148,820, entitled "Mechanical Locking System for Panels and Method of Installing Same," filed in the U.S. Patent and Trademark Office May 6, 2016.
U.S. Appl. No. 15/160,311, Darko Pervan, filed May 20, 2016.
U.S. Appl. No. 15/172,926, Darko Pervan and Agne Pålsson, filed Jun. 3, 2016.
U.S. Appl. No. 15/175,768, Darko Pervan, filed Jun. 7, 2016.
U.S. Appl. No. 15/217,023, Darko Pervan and Agne Pålsson, filed Jul. 22, 2016.
U.S. Appl. No. 15/229,575, Peter Derelov, filed Aug. 5, 2016.
U.S. Appl. No. 15/160,311, Pervan.
U.S. Appl. No. 15/172,926, Pervan et al.
U.S. Appl. No. 15/175,768, Pervan et al.
U.S. Appl. No. 15/217,023, Pervan et al.
U.S. Appl. No. 15/229,575, Derelöv.

(56) References Cited

OTHER PUBLICATIONS

Pervan, Darko, U.S. Appl. No. 15/160,311, entitled "Mechanical Locking System for Floor Panels," filed in the U.S. Patent and Trademark Office May 20, 2016.
Pervan, Darko, et al., U.S. Appl. No. 15/172,926, entitled "Mechanical Locking of Floor Panels with a Flexible Bristle Tongue," filed in the U.S. Patent and Trademark Office Jun. 3, 2016.
Pervan, Darko, et al., U.S. Appl. No. 15/175,768, entitled "Mechanical Locking System for Floor Panels," filed in the U.S. Patent and Trademark Office Jun. 7, 2016.
Pervan, Darko, et al., U.S. Patent Appl. No. 15/217,023, entitled "Mechanical Locking System for Floor Panels," filed in the U.S. Patent and Trademark Office Jul. 22, 2016.
Derelöv, Peter, U.S. Appl. No. 15/229,575, entitled "Building Panel with a Mechanical Locking System," filed in the U.S. Patent and Trademark Office Aug. 5, 2016.
U.S. Appl. No. 15/365,546, Christian Boo, filed Nov. 30, 2016.
U.S. Appl. No. 15/365,546, Boo.
Boo Christian, U.S. Appl. No. 15/365,546, entitled "Building Panel With a Mechanical Locking System," filed in the U.S. Patent and Trademark office Nov. 30, 2016.
Extended European Search Report dated Feb. 15, 2015 in EP 12 815 189.1, European Patent Office, Munich, DE, 9 pages.
U.S. Appl. No. 15/261,071, Darko Pervan, filed Sep. 9, 2016.
U.S. Appl. No. 15/261,071, Pervan.
Pervan, Darko, U.S. Appl. No. 15/261,071, entitled "Mechnical Locking System for Floor Panels," filed in the U.S. Patent and Trademark Office on Sep. 9, 2016.
U.S. Appl. No. 15/603,913, Darko Pervan, filed May 24, 2017.
Extended European Search Report dated Jan. 31, 2017 in EP 16184205.9, European Patent Office, Munich, DE, 12 pages.
Pervan, Darko, U.S. Appl. No. 15/603,913, entitled "Mechanical Locking System for Floor Panels," filed in the U.S. Patent and Trademark Office May 24, 2017.

* cited by examiner

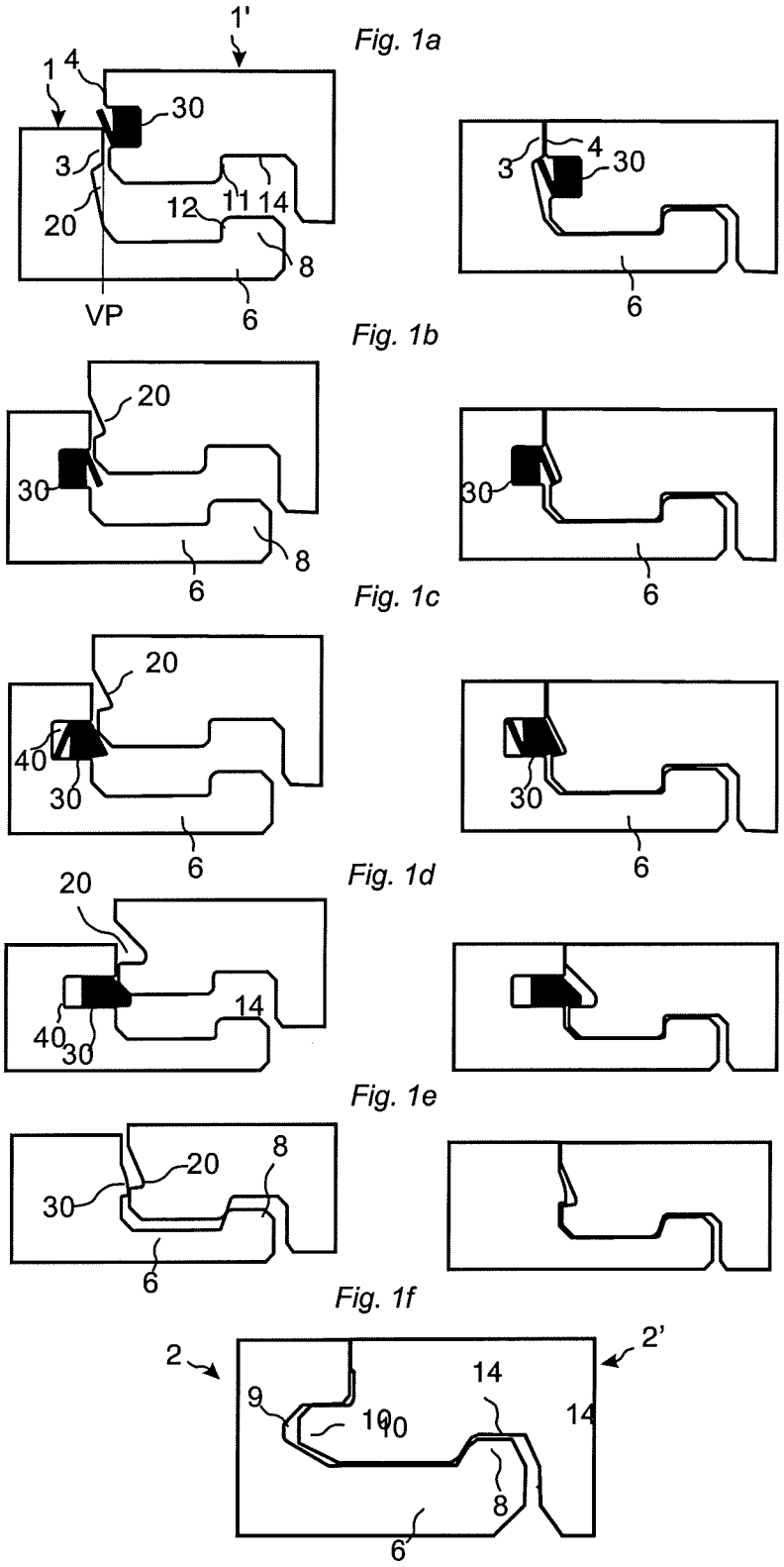
KNOWN TECHNOLOGY

MECHANICAL LOCKING SYSTEM FOR FLOOR PANELS

CROSS REFERENCE TO RELATED APPLICATIONS

The present application is a continuation of U.S. application Ser. No. 14/152,402, filed on Jan. 10, 2014, which is a continuation of U.S. application Ser. No. 13/546,569, filed on Jul. 11, 2012, now U.S. Pat. No. 8,650,826, which claims the benefit of U.S. Provisional Application No. 61/509,309, filed on Jul. 19, 2011. The entire contents of each of U.S. application Ser. No. 14/152,402, U.S. application Ser. No. 13/546,569 and U.S. Provisional Application No. 61/509,309 are hereby incorporated herein by reference in their entirety.

TECHNICAL FIELD

The disclosure generally relates to the field of mechanical locking systems for floor panels and building panels. The disclosure shows floorboards, locking systems, installation methods and production methods.

FIELD OF APPLICATION

The present disclosure is particularly suitable for use in floating floors, which are formed of floor panels which are joined mechanically with a locking system integrated with the floor panel, i.e. mounted at the factory, are made up of one or more upper layers of veneer, decorative laminate powder based surfaces or decorative plastic material, an intermediate core of wood-fibre-based material or plastic material and preferably a lower balancing layer on the rear side of the core.

The following description of known technique, problems of known systems and objects and features of the disclosure will therefore, as a non-restrictive example, be aimed above all at this field of application and in particular at panels formed as rectangular floor panels with long and shorts edges intended to be mechanically joined to each other on both long and short edges.

The long and short edges are mainly used to simplify the description of the disclosure. The panels may be square. The disclosure is preferably used on the short edges. It should be emphasized that the disclosure may be used in any floor panel and it may be combined with all types of known locking system formed on the long edges, where the floor panels are intended to be joined using a mechanical locking system connecting the panels in the horizontal and vertical directions on at least two adjacent sides.

The disclosure may also be applicable to, for instance, solid wooden floors, parquet floors with a core of wood or wood-fibre-based material and a surface of wood or wood veneer and the like, floors with a printed and preferably also varnished surface, floors with a surface layer of plastic or cork, linoleum, rubber. Even floors with hard surfaces such as stone, tile and similar materials are included and floorings with soft wear layer, for instance needle felt glued to a board. The disclosure may also be used for joining building panels which preferably contain a board material for instance wall panels, ceilings, furniture components and similar.

BACKGROUND

Laminate flooring usually comprises of a core of a 6-12 mm fibre board, a 0.2-0.8 mm thick upper decorative surface layer of laminate and a 0.1-0.6 mm thick lower balancing layer of laminate, plastic, paper or like material. A laminate surface consists of melamine-impregnated paper. The most common core material is fibreboard with high density and good stability usually called HDF—High Density Fibreboard. Sometimes also MDF—Medium Density Fibreboard—is used as core.

Traditional laminate floor panels of this type have been joined by means of glued tongue-and-groove joints.

In addition to such traditional floors, floor panels have been developed which do not require the use of glue and instead are joined mechanically by means of so-called mechanical locking systems. These systems comprise locking means, which lock the panels horizontally and vertically. The mechanical locking systems are usually formed by machining of the core of the panel. Alternatively, parts of the locking system may be formed of a separate material, for instance aluminium or HDF, which is integrated with the floor panel, i.e. joined with the floor panel in connection with the manufacture thereof.

The main advantages of floating floors with mechanical locking systems are that they are easy to install. They may also easily be taken up again and used once more at a different location.

DEFINITION OF SOME TERMS

In the following text, the visible surface of the installed floor panel is called "front side", while the opposite side of the floor panel, facing the sub floor, is called "rear side". The edge between the front and rear side is called "joint edge". By "horizontal plane" is meant a plane, which extends parallel to the outer part of the surface layer. Immediately juxta-posed upper parts of two adjacent joint edges of two joined floor panels together define a "vertical plane" perpendicular to the horizontal plane. By "vertical locking" is meant locking parallel to the vertical plane in D1. direction. By "horizontal locking" is meant locking parallel to the horizontal plane in D2 direction.

By "up" is meant towards the front side, by "down" towards the rear side, by "inwardly" mainly horizontally towards an inner and center part of the panel and by "outwardly" mainly horizontally away from the center part of the panel.

By "locking systems" are meant co acting connecting elements, which connect the floor panels vertically and/or horizontally.

RELATED ART AND PROBLEMS THEREOF

For mechanical joining of long edges as well as short edges in the vertical and in the first horizontal direction perpendicular to the edges several methods may be used. One of the most used methods is the angle-snap method. The long edges are installed by angling. The panel is than displaced in locked position along the long side. The short edges are locked by horizontal snapping. The vertical connection is generally a tongue and a groove. During the horizontal displacement, a strip with a locking element is bent and when the edges are in contact, the strip springs back and a locking element enters a locking groove and locks the panels horizontally. Such a snap connection is complicated since a hammer and a tapping block may need to be used to overcome the friction between the long edges and to bend the strip during the snapping action.

Similar locking systems may also be produced with a rigid strip and they are connected with an angling-angling method where both short and long edges are angled into a locked position.

Recently new and very efficient locking systems have been introduced with a separate flexible or displaceable integrated tongue on the short edge that allows installation with only an angling action, generally referred to as "vertical folding". Such a system is described in WO 2006/043893 (Välinge Innovation AB.

Several versions are used on the market as shown in FIGS. 1*a*-1*f*. FIG. 1*a*, 1*b* shows a flexible tongue 30 with a flexible snap tab extending from the edge. FIGS. 1*c*, 1*d* shows a displaceable tongue with an inner flexible part that is bendable horizontally in a cross section of the tongue or along the joint. Such systems are referred to as vertical snap systems and they provide an automatically locking during the folding action.

The locking system may also be locked with a side push action such that a displaceable tongue 30 is pushed into a locked position from the long side edge when adjacent sort side edges are folded down to the sub floor. Such a side push action could be difficult to combine with a simple angling and the friction may be too strong for wide panels.

FIG. 1*e* shows a fold down system with a flexible tongue 30 that is made in one piece with the core. FIG. 1*f* shows a long edge locking system in a fold down system that is connected with angling.

Although such systems are very efficient, there is still a room for improvements. Vertical snap systems are designed with the tongue on the strip panel. The reason is that an inclined sliding surface can only be formed on the fold panel when the upper edges are made without a bevel and this is generally the case. It is difficult to insert the separate tongue 30 during production into a groove 40 over a strip 6 comprising a locking element 8. The locking force is dependent on the snapping resistance. High locking force can only be accomplished with high snapping resistance when the tongue is pressed inwardly and when it snaps back into a tongue groove 40. This creates separation forces that tend to push the panels apart during folding. The locking may lose its strength if the flexibility and pressing force of the tongue decreases over time. The flexibility must be considerable and allow that a flexible tong is displaced in two directions about 1-2 mm. The material, which is used to produce such tongues, is rather expensive and glass fibres are generally used to reinforce the flexible tongue.

It would be a major advantage if the separate tongue could be fixed to the fold panel and if snapping could be eliminated in a system that locks automatically during folding.

SUMMARY

An overall objective of embodiments of the present disclosure is to provide a locking system for primarily rectangular floor panels with long and short edges installed in parallel rows, which allows that the short edges may be locked to each other automatically without a snap action that creates a locking resistance and separation forces of the short edges during folding. A specific objective is to provide a locking system with a separate displaceable tongue on the fold panel that may lock without any contact with the sharp upper edge of the strip panel and that the tongue is displaced essentially in one direction only from an inner part of a groove and outwardly.

The above objects of embodiments of the disclosure are achieved wholly or partly by locking systems and floor panels according to the independent claims. Embodiments of the disclosure are evident from the dependent claims and from the description and drawings.

A first aspect of the disclosure are building panels provided with a locking system for vertical locking of a first and a second building panel by a vertical displacement of the panels relative each other. A sidewardly open tongue groove is provided at an edge of the first building panel. A strip protrudes below the tongue groove and outwardly beyond the upper part of the edge of said first panel. A displaceable tongue is provided in a sidewardly open displacement groove at an edge of the second building panel. The displaceable tongue comprises main body extending along the edge of the second panel and preferably a tongue locking surface, located at an upper and outer part of the displaceable tongue, configured to cooperate with a groove locking surface of the tongue groove for a vertical locking of the first and the second building panel. The displaceable tongue comprises an inner part, spaced inwardly from an upper part of an edge of said second panel, the inner part comprises a tongue pressing surface configured to cooperate with a strip pressing surface on the strip. The displaceable tongue is configured to be displaced into the tongue groove when the tongue and the strip pressing surface are displaced vertically against each other to obtain the vertical locking.

The displaceable tongue is preferably an injection-moulded tongue.

The displaceable tongue may be asymmetric and comprising a protrusion and the second panel may comprise a cavity for housing the protrusion.

The protrusion may comprise a flexible part.

The strip may be provided with a locking element that cooperates with a downwardly open locking groove formed on the second panel for locking the first and the second building panel in a horizontal direction.

The tongue pressing surface is preferably positioned on the protrusion and the strip pressing surface is preferably located on the locking element.

The strip pressing surface is most preferably located on an inclined surface of the locking element that is directed towards the edge of the first building panel.

The locking system may comprise a cavity that extends from the displacement groove to the locking groove.

The strip and the tongue pressing surfaces may be inclined against a horizontal plane with an angle of about 25 to 75 degrees.

The displacement groove may be inclined and comprise an inner part that extends downwards.

The building panels may be locked vertically by two pairs of cooperating surfaces comprising the groove locking surface and the tongue locking surface, and an upper part of the strip and a lower part of the edge of the second panel, respectively.

The groove locking surface and the tongue locking surface may be inclined against a horizontal plane.

The groove locking surface and the tongue locking surface may be inclined with an angle of about 10 to 60 degrees to a horizontal plane.

The displaceable tongue may be provided with a flexible friction element.

The displaceable tongue may comprise at least two protrusions extending from the main tongue body and each protrusion may comprise said tongue pressing surface located at an outer part of the protrusion that during locking is in contact with a locking element provided on the strip.

The building panel may be a floor panel and the outer part of the displaceable tongue is preferably in an unlocked position located in the displacement groove.

The displacement groove may extend vertically above the locking groove.

The locking groove may be located vertically below the upper part of the displacement groove.

An upper part of the locking element may be located vertically below the tongue locking surface of the displaceable tongue.

An upper part of the locking groove may be located vertically below the tongue locking surface of the displaceable tongue.

The innermost part of the displaceable tongue may be below the outermost part of such tongue.

The tongue pressing surface may be located vertically below the tongue locking surface.

An upper part of the locking element may be located in the lower half of an intermediate core of the first building panel.

The strip may be flexible such that it bends downwards during locking.

The cavity may be larger than the protrusion such that there is a space S of at least about 1-3 mm.

The displaceable tongue may be gradually inserted into the tongue groove from a tongue part, which is adjacent an installed long edge, to another tongue part adjacent a free long edge.

BRIEF DESCRIPTION OF THE DRAWINGS

The disclosure will in the following be described in connection to exemplary embodiments and in greater detail with reference to the appended exemplary drawings, wherein:

FIGS. 1*a-f* illustrate locking systems according to known technology.

DESCRIPTION OF EMBODIMENTS OF THE DISCLOSURE

Figure 2A:
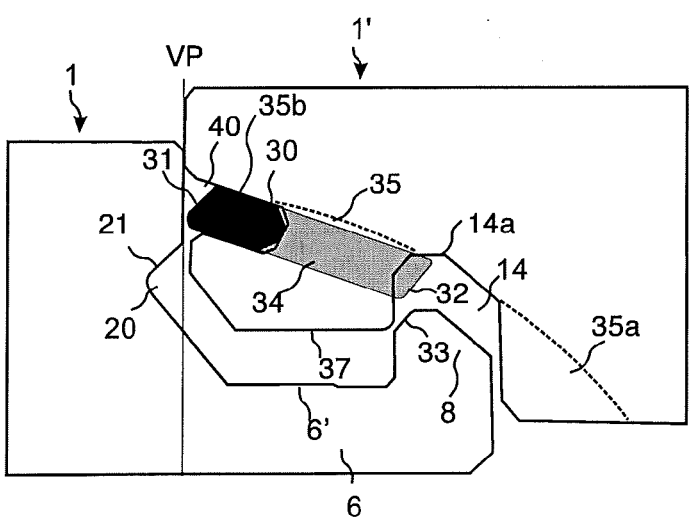
FIGS. 2*a-d* illustrate a short edge locking system according to an embodiment of the disclosure.
Figure 2B:
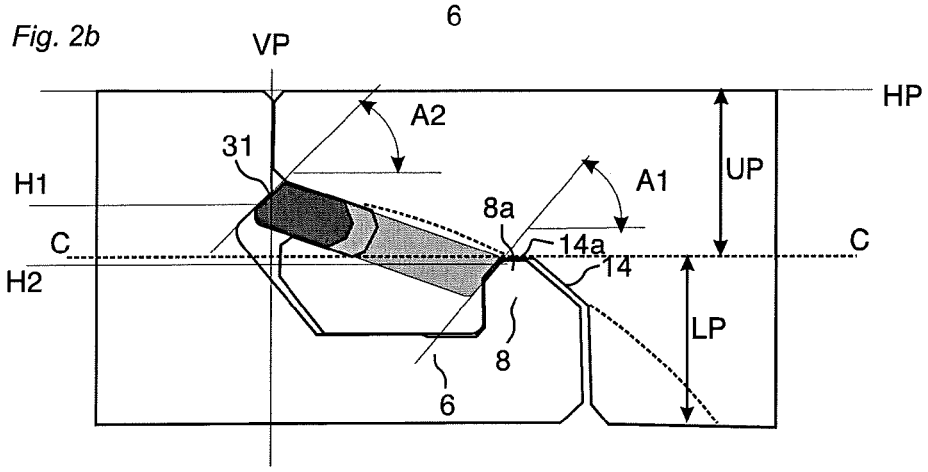
Figure 2C:
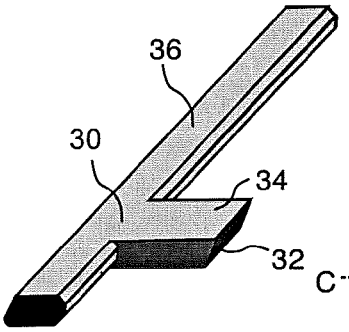

To facilitate understanding, several locking systems in the figures are shown schematically. It should be emphasized that improved or different functions may be achieved using combinations of the preferred embodiments.

All embodiments may be used separately or in combinations. Angles, dimensions, rounded parts, spaces between surfaces etc. are only examples and may be adjusted within the basic principles of the disclosure.

FIGS. 2*a*-2*d* show a first preferred embodiment of a short edge locking system provided with a flexible and displaceable tongue 30 in an edge of a second panel 1' inserted in a displacement groove 40 and extending along the edge of the second panel. The displaceable tongue 30 has a tongue locking surface 31 located at an upper and outer part that cooperates with a groove locking surface 21 located at an inner and upper part of a tongue groove 20 formed in an adjacent edge of a first panel 1. The locking surfaces lock the panels in a first vertical direction. The locking surfaces are preferably inclined with an angle A2 that is about 10-60 degrees. The displacement groove is preferably also inclined and the outer part is closer to the panel surface than an inner part.

The first panel 1 comprises a protruding strip 6 that extends outwardly beyond a vertical plane VP. The strip comprises a locking element 8. The second panel 1' comprises a locking groove 14 that cooperates with the locking element 8 and locks the panels in a horizontal direction. The strip 6 has an upper part 6, which is in contact with a lower part 37 of the adjacent edge and locks the panels in a second vertical direction.

The displaceable tongue 30 comprises a protrusion 34 extending from a main tongue body 36. The second panel 1' comprises at least one cavity 35 for housing the protrusion. The cavity extends from the displacement groove to the locking groove 14.

The cavity may be formed by a screw cutter or by displaceable saw blades.

The protrusion comprises a tongue pressing surface 32 which cooperates with a strip pressing surface 33 on the locking element. The strip pressing surface 33 and the tongue pressing surface 32 are inclined with an angle A1 which is preferably 25-75 degrees against a horizontal plane HP.

The displaceable tongue is displaced essentially in one direction towards the tongue groove when the inclined pressing surfaces are sliding against each other during the vertical displacement of the adjacent edges. The tongue may be locked with a strong pressure against the tongue groove 21 and the locking element 14 prevents the tongue from sliding back into the displacement groove.

Figure 2D:
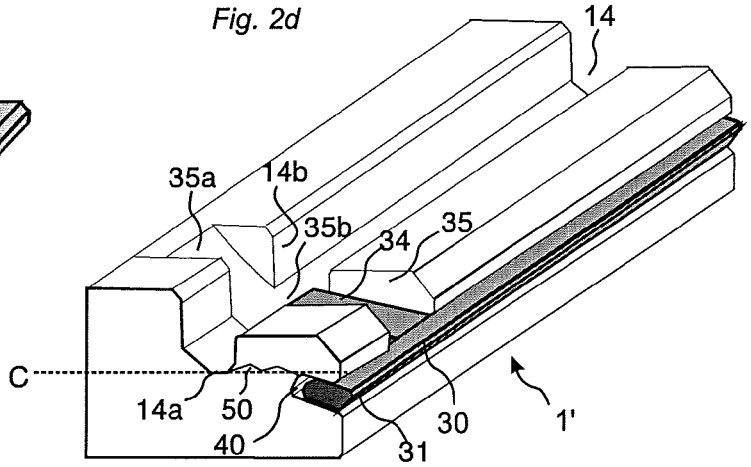
Figure 3A:
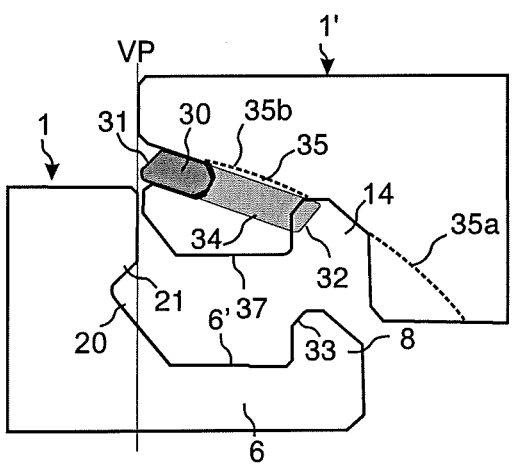
FIGS. 3*a*-3*d* illustrate a short edge locking system according to preferred embodiments of the disclosure.
Figure 3B:
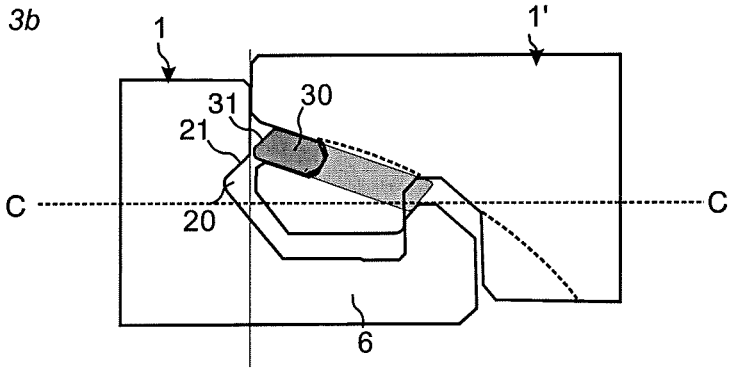
Figure 3C:
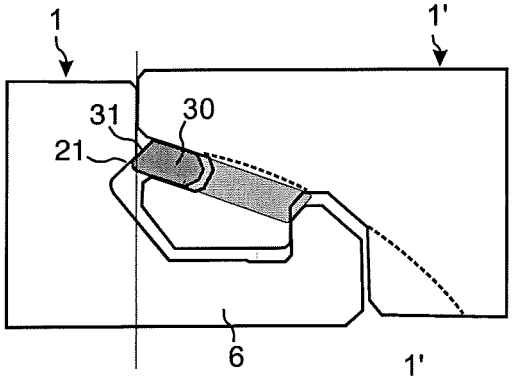
Figure 3D:
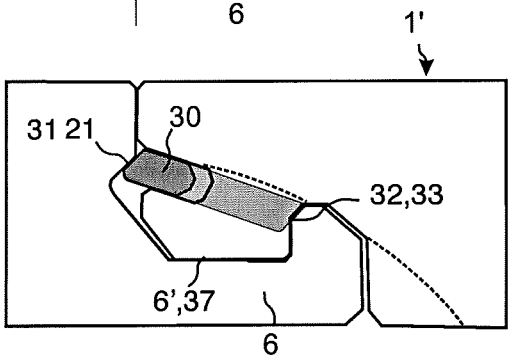

One major problem related to a "press lock system" as described above is the risk that they may split with a crack 50 between the displacement groove 40 and the locking groove 14 as shown in FIG. 2*d*. Therefore it is preferable that the upper parts of the locking groove 14*a* and the locking element 8*a* are made in the lower part of the floor panel, preferably below the center line C that divides the floor panel in two equal parts, one upper part UP and one lower part LP. It is also preferable that the tongue pressing surface 32 is located vertically below the tongue locking surface 31. The tongue pressing surface and the tongue locking surface are preferably offset vertically and are preferably located on different horizontal planes H2, H1. It is also preferred that an upper part of the locking element 8*a* and/or an upper part of the locking groove 14*a* are located vertically below the tongue locking surface 31. The innermost part of the displaceable tongue 30 is preferably located below the outermost part of such tongue.

The cavities 35 are preferably formed by rotating saw blades and comprise preferably an upper rounded part with an outer part 35*b* that is located above an inner part 35*a* as shown in FIG. 2*d*. The cavity is preferably formed such that it intersects the inner part 14*b* of the locking groove 14.

FIGS. 3*a*-3*d* show the locking function during the vertical displacement of the second panel 1' against the first panel 1. The displaceable tongue 30 is gradually pressed into the tongue groove 20 by the cooperating pressing surfaces 32,33 and the panels are locked vertically with two pairs of cooperating locking surfaces, the tongue locking surface 31 and the groove locking surface 21 and an upper part 6' of the strip 6 and a lower part 37 of the adjacent edge 1'.

Figure 4A:
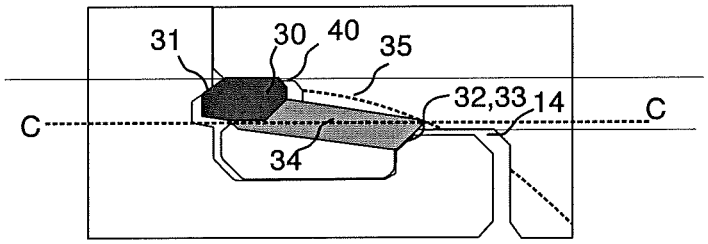
FIGS. 4*a-e* illustrate preferred embodiments of short edge locking systems.
Figure 4B:
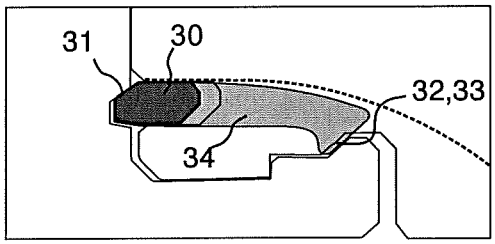
Figure 4C:
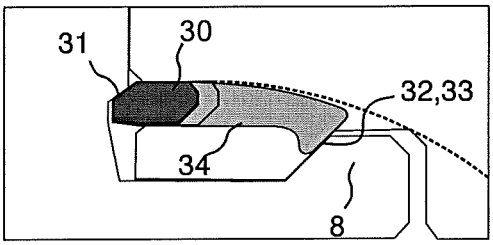
Figure 4D:
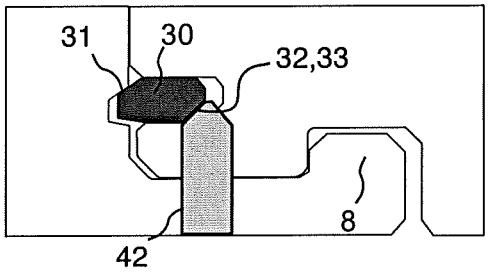
Figure 4E:
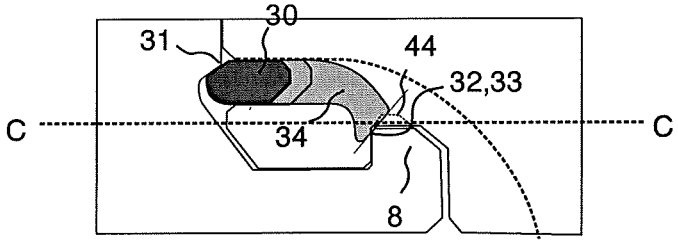

FIGS. 4*a*-4*e* show different embodiments. FIG. 4*a* shows a displaceable tongue 30 with a protrusion 34 located under the main tongue body. The locking groove 14 is located vertically under an upper part of the displacement groove 40. FIG. 4*b* shows a tongue pressing surface 32 that locks against a strip pressing surface that is not active in the horizontal locking. FIG. 4*c* shows that the same locking surface 33 on the locking element 8 may be used as a pressing surface and as a locking surface for the horizontal locking. FIG. 4*d* shows that the strip pressing surface may be formed on a separate pushing rod 42. FIG. 4*e* shows a protrusion 34 that comprises a curved cross section and a locking element that comprises an upper part 44 formed as local protrusion that protrudes above the inner part of the locking groove 14 and into the cavities 35.

Figure 5A:
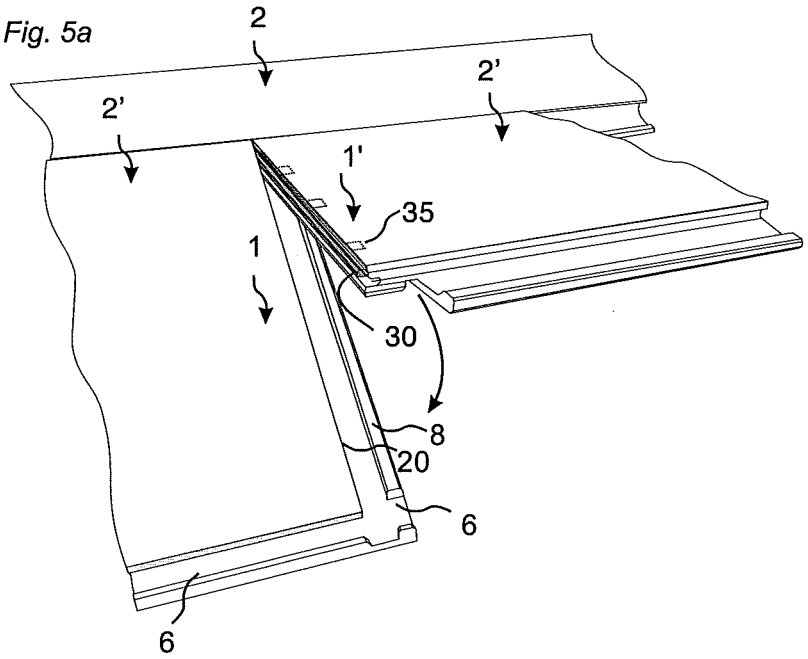
FIGS. 5*a-e* illustrate vertical folding of three panels according to an embodiment of the disclosure.
Figure 5B:
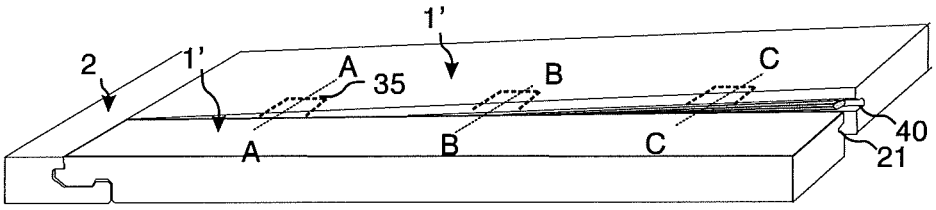
Figure 5C:
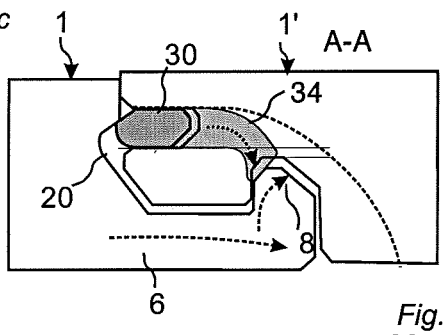
Figure 5D:
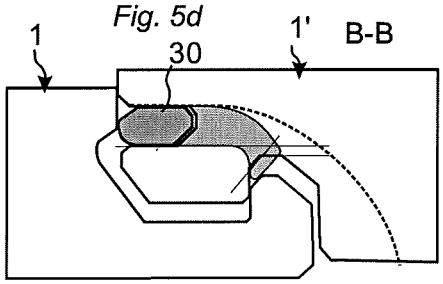
Figure 5E:
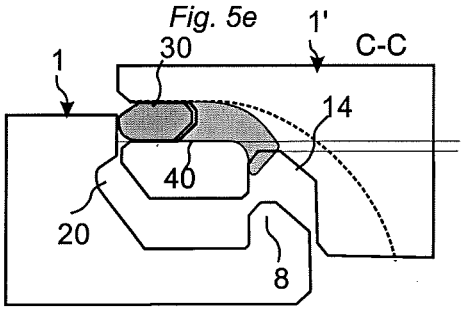

FIGS. 5*a*-5*e* show vertical folding of three panels wherein the long edges 2,2' are connected with angling and the short edges 1, 1' with a scissor like motion that combines angling and vertical displacement. FIG. 5*b* shows that the displaceable tongue is gradually inserted into the tongue groove 20 from one part of the edges that is adjacent to the installed long edge 2 to the other free long edge. FIG. 5*c* shows the tongue in the cross section A-A and FIGS. 5*d*, 5*e* show the tongue position in the cross sections B-B, and C-C. The strip 6 and the locking element 8 are in this embodiment designed such that they bend backwards during locking and this facilitates locking since the necessary flexibility may be provided partly or completely with such strip bending. The locking groove is positioned vertically under the lower part of the displacement groove 40.

Figure 6A:
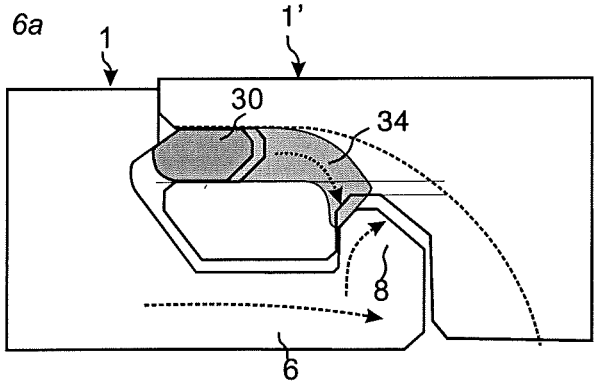
FIGS. 6*a-e* illustrate the flexibility of the locking systems during locking and preferred embodiments of displaceable tongues.

FIG. 6*a* shows that the locking system may be formed such that several parts are flexible for example the protrusion 34, the locking strip 6 and the locking element 8. This flexibility may be used to eliminate production tolerances and to facilitate an easy and strong locking. FIG. 6*a* shows that the strip 6 may be bended downwards and the locking element 8 may be bended downwards and outwardly. Such a strip bending may facilitate locking that may even be accomplished with a displaceable tongue that comprises a limited flexibility such as a tongue that essentially comprises wood fibre material. A locking be accomplished with a flexibility where a part of the displaceable tongue 30 is bended or compressed marginally for example only about 0.1-1.0 mm in the horizontal direction.

Figure 6B:
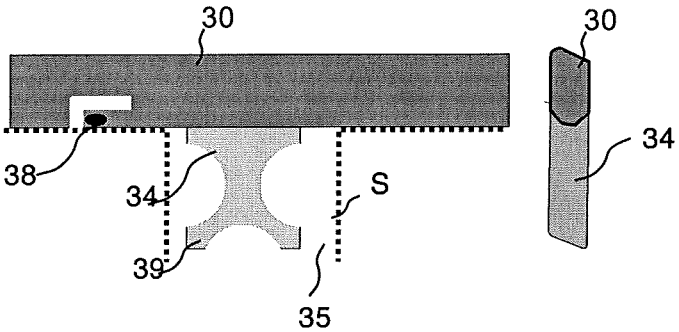
Figure 6C:
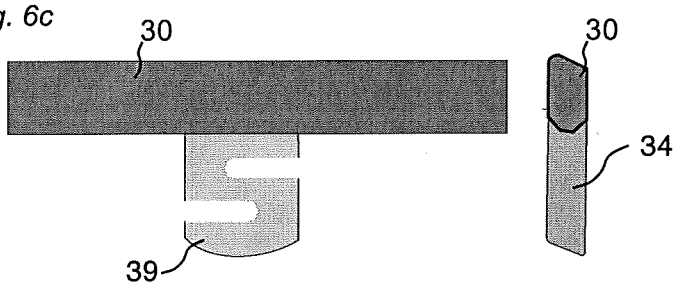

FIGS. 6*b* and 6*c* show embodiments of the tongue. The displaceable tongue may be fixed into the displaceable groove with a friction connection 38. The protrusion 34 may comprise flexible parts 39 that create a pre-tension against the tongue groove 20. The cavity 35 may be considerably larger than the protrusion and preferably there is a space S that may be about 1-3 mm.

Figure 6D:
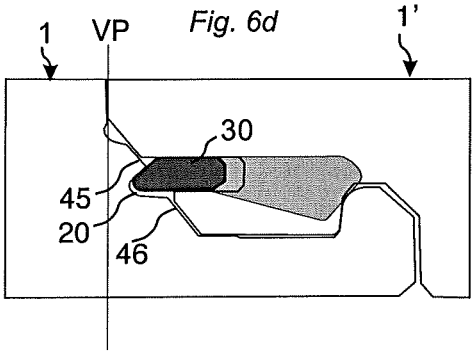

FIG. 6*d* shows a locking system with a sliding surface 45 that protrudes beyond a vertical plane VP. The tongue groove 20 is preferably formed on an inclined edge surface 46. Such an embodiment offers the advantages that the displaceable tongue 30 may be pressed inwardly and the conventional two-way snapping action may be combined with a one way pressing motion that may be used to create the final locking.

Figure 6E:
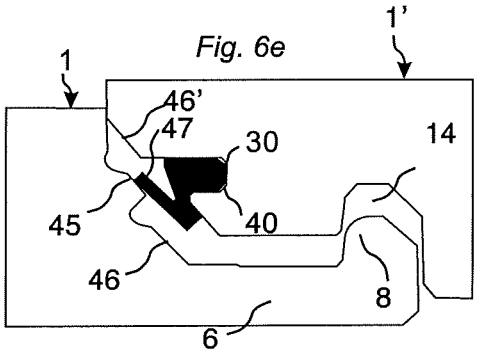

FIG. 6*e* shows a separate tongue 30, located in a sideway open groove 40 on the second panel 1', comprising an upwardly extending snap tab 47 that cooperates with a downwardly extending sliding surface 45 that is located on the first panel 1 and that protrudes beyond the upper edge and the vertical plane VP. The second panel 1' comprises preferably an inclined edge surface 46' located above and and/or below the tongue 30. An easy snapping may be obtained even with panels that have straight and sharp upper adjacent edges. The snap tab may be replaced with a displaceable tongue that comprises flexible snapping protrusions along its length. The locking system shown in FIG. 1*d* may also be adjusted such that it comprises inclined edge surfaces and such a design may be used to increase the strength of the joint.

The locking system according to the disclosure may also be formed without a locking grove 14 and a locking element 8 such that it only locks the edges in a vertical direction. The locking element 8 may be replaced with local protrusions that extend upwards from a strip 6 and are in locked position located in the cavities. The short edges may be locked horizontally by friction between the long edges.

All locking systems may be designed such that they be unlocked with angling and/or sliding along the edges.

Figure 7A:
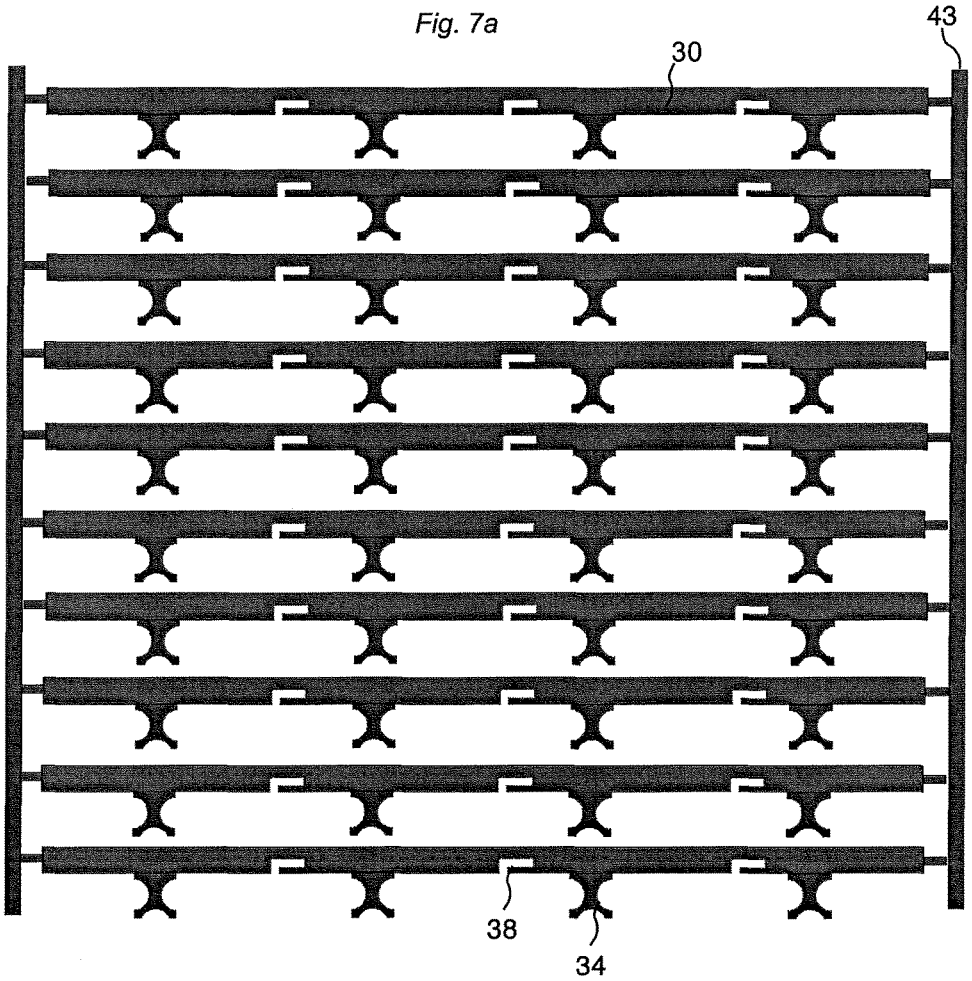
FIGS. 7*a-b* illustrate tongue blanks according to embodiments of the disclosure comprising several displaceable tongues.
Figure 7B:
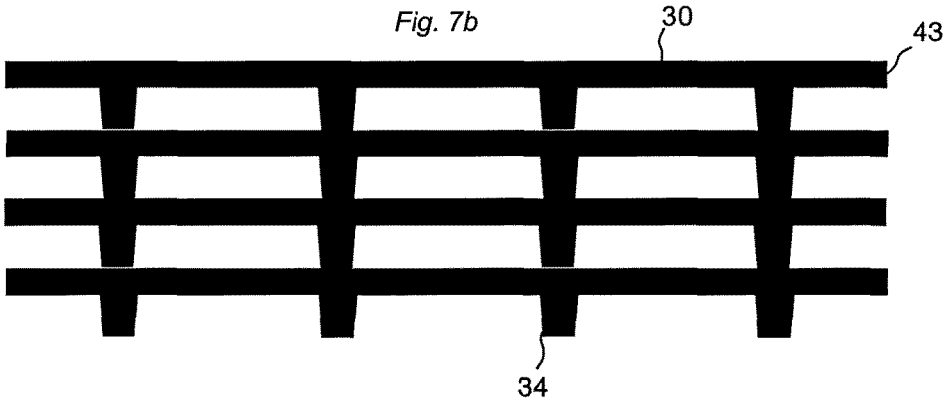

FIG. 7*a*, 7*b* show a tongue blank 43 that comprise several displaceable tongues that are preferably asymmetric along the tongue length. FIG. 7*a* shows injection-moulded tongues 30 and FIG. 7*b* shows displaceable tongues 30 made of a wood based material that is preferably machined and punched.

The cavities 35 that are preferably formed by rotating saw blades comprises an upper part that is rounded and may comprise an inner part that is located below an outer part. The locking system may be partly or completely formed by carving tools.

While illustrative embodiments of the invention have been described herein, the present invention is not limited to the various preferred embodiments described herein but includes any and all embodiments having equivalent elements, modifications, omissions, combinations (e.g. of aspects across various embodiments), adaptations and/or alterations as would be appreciated by those in the art based on the present disclosure. The limitations in the claims are to be interpreted broadly based on the language employed in the claims and not limited to the examples described in the present specification or during prosecution of the application, which examples are to be construed as non-exclusive.

The invention claimed is:

1. Building panels provided with a locking system for vertical locking of a first and a second building panel by a vertical displacement of the panels relative to each other, wherein juxtaposed upper parts of adjacent joint edges of the first and second building panels in a locked position define a vertical plane, and wherein the building panels comprise:

a strip on said first building panel and protruding outwardly from the vertical plane and beyond an upper part of an edge of said first building panel, and a displaceable tongue provided in a sidewardly open displacement groove at an edge of the second building panel, wherein the displaceable tongue comprises a flexible part configured to cooperate with the strip such that the displaceable tongue is displaced from a position out of a tongue groove provided at the edge of said first building panel and above a lowest part of an upper surface of the strip to a position in the tongue groove when the first building panel and the second building panel are displaced vertically relative to each other to obtain a locking of the first building panel and the second building panel in a vertical direction, and wherein the flexible part creates a pre-tension against the tongue groove in an installed state of the first building panel and the second building panel.

2. The building panels as claimed in claim 1, wherein the flexible part is provided inwardly of an upper part of the edge of the second building panel in the installed state of the first building panel and the second building panel.

3. The building panels as claimed in claim 1, wherein said flexible part is provided on a protrusion extending in a transverse direction from a main body of the displaceable tongue.

4. The building panels as claimed in claim 3, wherein the second building panel comprises a cavity for housing the protrusion.

5. The building panels as claimed in claim 3, wherein the main body of the displaceable tongue has a length along the edge of the second building panel in a horizontal direction, and the protrusion has a length along the edge of the second building panel in the horizontal direction, and the length of the protrusion is less than the length of the main body.

6. The building panels as claimed in claim 3, wherein the displaceable tongue has a tongue locking surface that contacts a groove locking surface of the tongue groove for vertical locking of the first building panel and the second building panel, and the tongue locking surface and the groove locking surface are congruently inclined.

7. The building panels as claimed in claim 4, wherein the cavity is larger than the protrusion.

8. The building panels as claimed in claim 4, wherein the strip comprises a locking element configured to cooperate with a locking groove formed on the second building panel, for locking the first building panel and the second building panel in a horizontal direction, and the cavity extends from the sidewardly open displacement groove into the locking groove.

9. The building panels as claimed in claim 1, wherein the flexible part is S-shaped in a plane coinciding with an upper part of the displaceable tongue.

10. The building panels as claimed in claim 1, wherein a width of the flexible part in a longitudinal direction of the displaceable tongue varies along a transverse direction of the flexible part.

11. The building panels as claimed in claim 1, wherein a transverse length of the flexible part varies along a longitudinal direction of the displaceable tongue.

12. The building panels as claimed in claim 1, wherein the flexible part is flexible in a direction transverse to a longitudinal direction of the displaceable tongue.

13. The building panels as claimed in claim 1, wherein the displaceable tongue is configured to be displaced at an angle with respect to a horizontal plane extending parallel to a surface layer of the second building panel.

14. The building panels as claimed in claim 13, wherein the displaceable tongue is configured to be displaced obliquely upwards into the tongue groove during locking of the first building panel and the second building panel.

15. The building panels as claimed in claim 1, wherein the flexible part extends along a part of the displaceable tongue in a longitudinal direction of the displaceable tongue.

16. The building panels as claimed in claim 1, wherein the flexible part comprises a tongue pressing surface which is configured to cooperate with a strip pressing surface on the strip.

17. The building panels as claimed in claim 16, wherein the strip pressing surface is provided vertically below a groove locking surface of the tongue groove.

18. The building panels as claimed in claim 16, wherein the tongue pressing surface is located vertically below a tongue locking surface of the displaceable tongue with the tongue groove.

19. The building panels as claimed in claim 1, wherein there is a space between a lower and outer part of the displaceable tongue and a lower part of the tongue groove.

20. The building panels as claimed in claim 19, wherein said space is provided along an entirety of the edges of the first building panel and the second building panel in the installed state of the first building panel and the second building panel.

21. The building panels as claimed in claim 1, wherein a portion of the displaceable tongue is fixed in the sidewardly open displacement groove with a friction connection.

22. The building panels as claimed in claim 1, wherein said flexible part is provided on at least two protrusions extending in a transverse direction from a main body of the displaceable tongue.

23. The building panels as claimed in claim 1, wherein an innermost part of the displaceable tongue is provided vertically below an outermost part of the displaceable tongue in the installed state of the first building panel and the second building panel.

* * * * *